United States Patent [19]

Harbauer

[11] 4,002,411

[45] Jan. 11, 1977

[54] BALL TYPE DISPENSING PACKAGE

[75] Inventor: Paul W. Harbauer, Perrysburg, Ohio

[73] Assignee: Owens-Illinois, Inc., Toledo, Ohio

[22] Filed: Sept. 2, 1975

[21] Appl. No.: 609,338

[52] U.S. Cl. ..... 401/213; 401/214

[51] Int. Cl.[2] ..... B43K 9/00; B43K 7/10

[58] Field of Search ..... 401/213

[56] References Cited

UNITED STATES PATENTS

| | | | |
|---|---|---|---|
| 2,997,731 | 8/1961 | Schultz | 401/213 |
| 2,998,616 | 9/1961 | Gentile | 401/213 |
| 3,103,691 | 9/1963 | Stull | 401/213 |

*Primary Examiner*—Lawrence Charles
*Attorney, Agent, or Firm*—Steve M. McLary; E. J. Holler

[57] ABSTRACT

An improved ball dispensing package combination for liquid cosmetics and the like. A ball is held in place in a fitment which is attached to the finish portion of a container for the product to be dispensed. The ball is allowed to move freely within the fitment to allow dispensing. The total package is completed by a closure which engages threads on the exterior of the finish portion. The closure has an internal downwardly depending sealing ring which engages the upper rim of the fitment as the closure is tightened. Simultaneously, the lower portion of an internal cavity of the closure engages the ball at its maximum chordal dimension. The ball does not touch the upper portion of the internal cavity, so any material on the ball does not tend to stick to the closure.

1 Claim, 5 Drawing Figures

BALL TYPE DISPENSING PACKAGE

BACKGROUND OF THE INVENTION

This invention generally relates to ball type applicators. More specifically, this invention relates to a complete ball type applicator package, including a closure. Particularly, this invention relates to such a package which has a dual seal and in which the ball itself is not stressed to effect the seal.

The ball type applicator is well known in the art for the dispensing of liquid cosmetics of various types. Examples of pertinent prior art patents may be seen in the following U.S. Pat. Nos. 2,904,810; 2,823,403; 2,910,712; 3,036,328; and 3,090,987. The package shown in U.S. Pat. No. 2,823,403 has proven very successful commercially and has been widely used. One problem with this package was that the ball was pressed against resilient ribs to seal the package. This stressing of the ribs tended to lead to erratic dispensing near the end of package life. In addition, the closure seated on the top of the ball. If the ball were wet with package contents, the closure would have a tendency to stick to the ball as the ball dried, leading the difficult closure removal. I have solved this problem by designing a package in which the closure seats on the ball retaining fitment, without distortion of the fitment, to give one seal point. Simultaneously, the lower most portion of an internal cavity in the closure seals on the maximum chordal dimension of the extending portion of the ball for a second seal point. There is no way for the material on the ball to dry out during storage, so closure removal problems are eliminated. In addition, a wet ball, ready for use, is presented as soon as the closure is removed.

SUMMARY OF THE INVENTION

My invention is a dispensing package combination. The combination includes a container which has a neck portion defining an opening for dispensing the contents of the container. The neck portion includes external threads and a circumferential groove formed above the threads. An annular ball retaining fitment is made of a resilient material. An inwardly extending interior rib adjacent one end of the fitment is in engagement with the groove in the container. The fitment also includes a plurality of interior, inwardly extending flanges positioned intermediate the rib and the opposite end of the fitment. The end of the fitment opposite the rib terminates in a generally flat, outwardly tapering rim portion defining an opening through said fitment. A dispensing ball, with a diameter greater than the diameter of the fitment opening defined by its rim, has a majority portion inserted into and held by the fitment. The lower portion of the ball is seated on the flanges. A minority portion of the ball extends beyond the fitment to define a dispensing surface. A closure member is formed with internal threads to engage the external threads of the container neck. The closure member also includes an internal, downwardly depending sealing ring having a normal radius substantially equal to the radius of the rim portion of the fitment. The sealing ring is distorted into sealing engagement with the rim portion when the closure member is fully engaged on the neck portion. The closure member also includes an interior cavity which terminates adjacent the upper portion of the sealing ring. The maximum chordal dimension of the cavity at the terminus point is slightly less than the chordal dimension of the ball at this same point. This creates a seal between the ball and the interior cavity at this location while the rest of the ball minority part is kept from contact with the interior cavity.

DETAILED DESCRIPTION OF THE DRAWINGS

Figure 1:
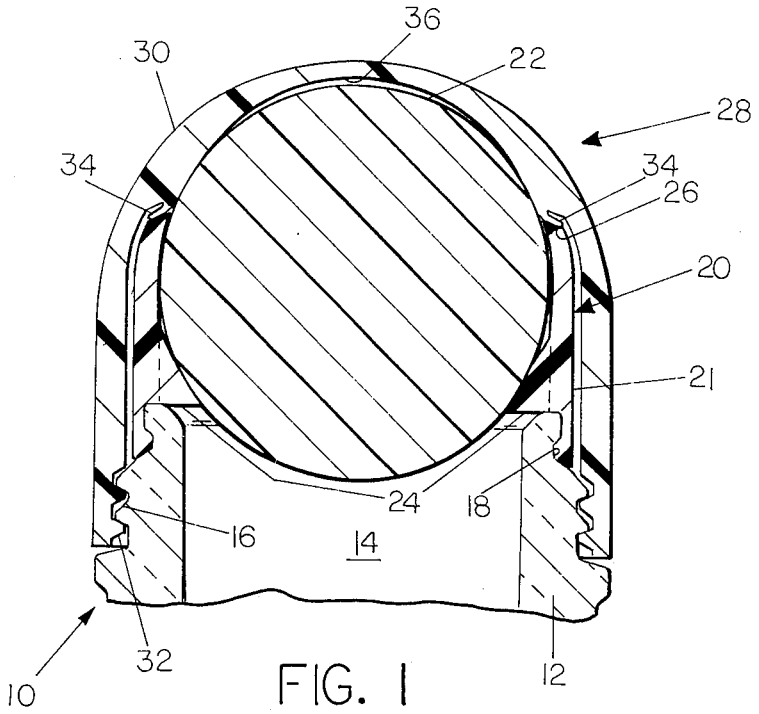
FIG. 1 is a cross sectional side elevation view of the complete dispensing package of the present invention in its sealed configuration.
Figure 2:
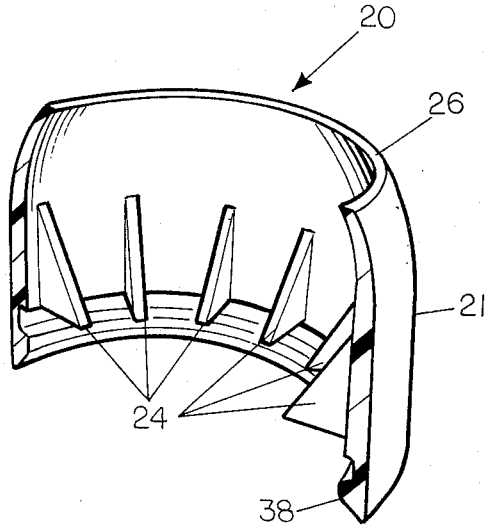
FIG. 2 is a partial perspective view, on an enlarged scale, of the ball retaining fitment of the present invention.

As seen in FIG. 1, the combination package of the present invention includes a container 10 for deodorants, perfume or similar cosmetics that are commonly applied directly to the body. The container 10 includes a neck or finish portion 12 which has an opening 14 formed therein. The exterior portion of the neck 12 has threads 16 formed therein. Above the threads 16, a groove 18 is also formed in the neck 12. A retaining fitment 20 is snapped into the groove 18 and is permanently held in place. The fitment 20 is preferably formed of a relatively elastic material such as polyethylene and has a generally annular shaped sidewall 21 so that the contents of the container 10 may be dispensed through the fitment 20. A ball 22, of glass, plastic or any other suitable material, is held in place adjacent the opening 14 in the neck 12 by the fitment 20. The lower end of the ball 22 extends partially into the opening 14 in the neck 12 and its position is fixed by a plurality of inwardly, extending flanges 24 that are integrally formed with the interior of the sidewall 21. The flanges 24 serve as a lower seat for the ball 22 and basically determine or fix its location. As can be best seen in FIG. 2, the sidewall 21 actually tapers inwardly slightly at its end opposite the flanges 24. The diameter at this end is smaller than the diameter of the ball 22. The ball 22 is placed in the fitment 20 by forcing the ball 22 in the end of the fitment 20 and then allowing this end of the fitment 20 to snap back. The fitment 20 actually does not contact the ball 22 at its upper most edge. Rather, there is a slight clearance at this point, which is exaggerated in the drawings, to allow the dispensing of material which may be carried by the ball 22. The ball 22 is actually free to move up and down, leading to very smooth and easy dispensing. Note that the portion of the ball 22 which extends above the top of the fitment 20 is a minor portion of the ball 22, and therefore the chordal dimension of the portion above the fitment 20 is smaller than the maximum diameter of the ball 22. As best seen in FIG. 2, the top of the sidewall 21 terminates in a relatively flat rim portion 26 which tapers away from the centerline of the package. A closure 28 completes the package and is shown in sealing engagement in FIG. 1. The closure 28 has a generally dome shaped body member 30 which includes internal threads 32 which engage with the threads 16 on the neck 12 and allow sealing of the closure 28 to the ball 22. The dome shape is not an absolute requirement and the more conventional cup-shaped closure could also be used. The interior of the closure 28 includes a downwardly depending sealing ring 34. The sealing ring 34 in its normal unstressed condition extends basically vertically downward with a slight taper away from the centerline. When the closure 28 is applied to the container 10, the sealing ring 34 is pressed against the rim 26 on the top of the fitment 20 and is distorted outwardly. This distortion presses the sealing ring 34 tightly against the flat rim surface 26 and provides a seal to prevent escape of material from the interior of the container 10 when the closure 28 is in place. This action furthermore has the effect of pressing the fitment 20 down into tight contact with the top of the neck 12. This helps seal off the interior of the container 10 from the atmosphere outside. An additional very important feature of the closure 28 is an interior cavity 36 which is formed adjacent to the sealing ring 34. The interior cavity 36 is dimensioned such that its maximum diametrical dimension, or chordal dimension to be more precise, is immediately adjacent to the upper most portion of the sealing ring 34. This dimension is chosen to be equal to or slightly less than the chordal dimension of the minority portion of the ball 22 which extends above the top of the fitment 20. As can be seen in FIG. 1 the result of this precise dimensional configuration is that when the closure 28 is fully tightened, the lower most portion of the interior cavity 36 comes into sealing, abutting engagement with the ball 22. However, the cavity 36 is carefully sized such that the upper portion of the cavity 36 remains out of contact with the ball 22. The precise shape of the cavity 36 can be that of a portion of a sphere or a spheroid of revolution, so long as it is dimensioned such that it will contact the largest chordal dimension of that portion of the ball 22 above the fitment 20 while allowing its upper portion to remain out of contact with the ball 22.

As seen in FIG. 2, the fitment 20 also includes an inwardly, extending rib 38. The rib 38 is formed near the lower most portion of the sidewall 21 and is engaged in the groove 18 in the neck portion 12 to hold the fitment 20 in position. Note that because the flanges 24 are spaced apart around the inside of the sidewall 21, there are spaces provided to which the product contained within the container 10 may be dispensed onto the ball 22 for application to the skin. The shape of the flanges 24 illustrated is that of a right triangle with the ball 22 resting on the hypotenuse of this triangle.

Figure 3:
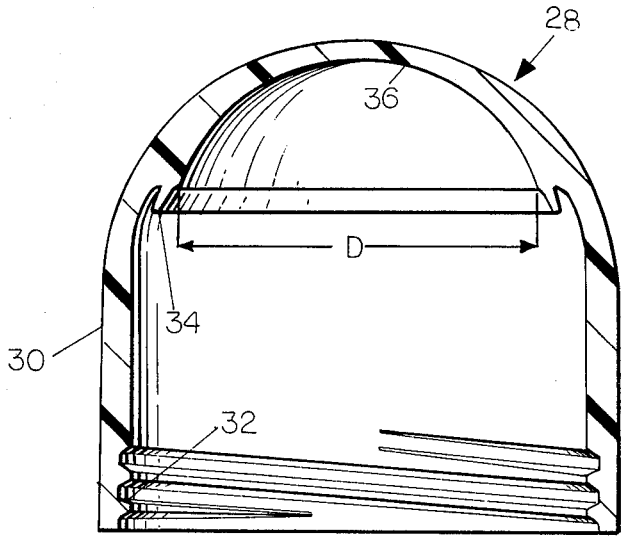
FIG. 3 is a cross sectional side elevation view of the closure member of the present invention.

FIG. 3 shows the closure 28 itself as removed from the container 10. This view is included to further illustrate the relationship of the cavity 36, its lower most diameter, and the sealing ring 34. The diameter designated as D in FIG. 3 is the diameter of the interior cavity 36 at its lower most point. Again, this diameter is chosen to be equal to the maximum chordal dimension of that portion of the ball 22 which extends above the fitment 20. This dimension is chosen so that the bottom of the internal cavity 36 is adjacent to the sealing ring 34. The sealing ring 34 is seen to be an elongated, relatively thin, fin like member.

Figure 4:
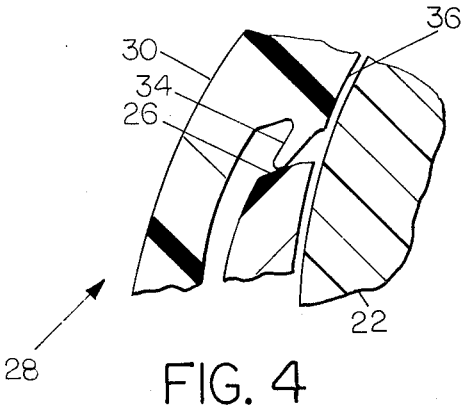
FIG. 4 is a cross sectional, side elevation view, on an enlarged scale, showing the configuration of closure, ball and fitment of the present invention just prior to tightening the closure.

FIG. 4 illustrates the configuration of the closure 28 relative to the fitment 20 and ball 22 prior to complete engagement of the threads 16 and 32. Note that the sealing ring 34 is just abutting on the rim 26 and is in an un-deformed condition. Also note that the lower portion of the cavity 36 is not in contact with the ball 22.

Figure 5:
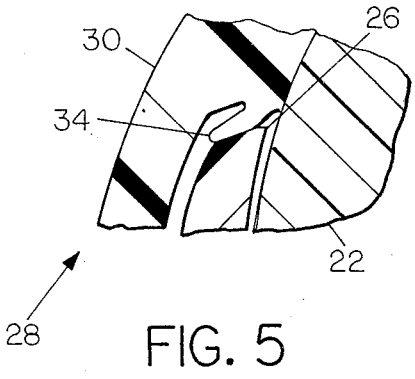
FIG. 5 is a view similar to FIG. 4 but with the closure engaged to the fully sealed position.

FIG. 5 then shows the sealing engagement of the sealing ring 34 with the rim 26 and the internal cavity 36 with the ball 22. This is precisely the configuration shown in FIG. 1, but the enlarged scale of FIG. 5 allows a better understanding of this dual seal configuration.

It can therefore be seen that what is provided is a dual seal arrangement for a ball dispensing type fitment. The dual seal allows the primary sealing to be done by a portion of the closure seating on the ball retaining fitment. The sealing is further perfected by seating a portion of an interior cavity of the closure 28 on the ball 22. The remainder of the interior cavity 36 is not in contact with the ball 22. Any material which may have been on the top of the ball 22 is prevented from drying out because it is sealed from the atmosphere, and, conversely, will not have a tendency to stick to the closure 28 since it is not in contact with the interior cavity 36. This then allows good sealing of the container 10 while allowing easy removal of the closure 28 since the contents do not have a tendency to dry or become stuck to the closure 28. Furthermore, the ball 22 and the fitment 20 are not stressed in any way to achieve the seal. Thus the clearance between the ball 22 and the fitment 20 can remain constant over the life of the package and provide uniform dispensing for all of the contents.

What I claim is:

1. An improved ball applicator dispensing package comprising, in combination:

a container having a neck portion defining an opening at the end thereof for dispensing the contents of said container, said neck portion including external threads and a circumferential groove formed above said threads;

an annular ball-retaining fitment of a resilient material having an inwardly extending rib adjacent one end thereof in engagement with said groove in said neck and a plurality of inwardly extending flanges intermediate said rib and the opposite end of said fitment, the end of said fitment opposite said rib terminating in a generally flat, downwardly and outwardly tapering rim portion defining an opening through said fitment;

a dispensing ball, having a diameter greater than the diameter of the opening in said fitment defined by said rim, with a majority portion thereof inserted and held by said fitment, the lower portion of said ball being seated on said flanges, with a minority portion of said ball extending beyond said fitment to define a dispensing surface; and a closure member having internal threads for engagement with the threads on said neck, said closure member including a downwardly depending annular sealing fin inclined away from the center line of said closure and having a normal diameter substantially equal to the diameter of the downwardly and outwardly tapering rim portion of said fitment, said sealing fin being distorted outwardly into sealing engagement with said rim portion when said closure member is fully engaged on the neck portion of said container to thereby create a primary seal between said closure member and said retaining fitment without distorting said retaining fitment or said dispensing ball, and further including an interior cavity terminating adjacent the inner edge of said sealing fin and having a maximum chordal dimension at said terminus slightly less than the chordal dimension of said ball at the point to thereby create a secondary seal between said wall and said interior cavity at this location with the remainder of said ball minority part being out of engagement with said interior cavity.

* * * * *

UNITED STATES PATENT AND TRADEMARK OFFICE

CERTIFICATE OF CORRECTION

PATENT NO. : 4,002,411

DATED : January 11, 1977

INVENTOR(S) : PAUL W. HARBAUER

It is certified that error appears in the above-identified patent and that said Letters Patent are hereby corrected as shown below:

Col. 4, line 65, "wall" should be --ball--.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*